US005291809A

United States Patent [19]

Fox, III et al.

[11] Patent Number: 5,291,809

[45] Date of Patent: Mar. 8, 1994

[54] LOCKING ADAPTER FOR SOCKET WRENCH

[76] Inventors: Leonard J. Fox, III, 1920 College Blvd., #278, Oceanside, Calif. 92056; Bruce A. Heckbert, 120 Tampa St., West Warwick, R.I. 02893

[21] Appl. No.: 117,635

[22] Filed: Sep. 7, 1993

Related U.S. Application Data

[63] Continuation of Ser. No. 8,421, Jan. 25, 1993, abandoned, which is a continuation of Ser. No. 844,457, Mar. 2, 1992, abandoned.

[51] Int. Cl.[5] ..... B25B 13/00

[52] U.S. Cl. ..... 81/177.85; 81/177.2

[58] Field of Search ..... 81/177.85, 177.2, 177.75, 81/177.1; 408/322, 325, 328, 358, 361, 365, 368, 108, 109

[56] References Cited

U.S. PATENT DOCUMENTS

| | | | |
|---|---|---|---|
| 1,864,466 | 6/1932 | Peterson | 81/177.85 |
| 2,987,334 | 6/1961 | Wendling | 81/177.85 X |
| 4,297,924 | 11/1981 | Stephens | 81/59.1 |
| 4,367,663 | 1/1983 | Merics | 81/177 A |
| 4,399,722 | 8/1983 | Sardo, Jr. | 81/60 |
| 4,480,511 | 11/1984 | Nickipuck | 81/177 G |
| 4,502,365 | 3/1985 | Hacker | 81/177 G |
| 4,589,308 | 5/1986 | Palm | 81/177.85 |
| 4,733,584 | 3/1988 | Karge | 81/177.85 |
| 4,781,085 | 11/1988 | Fox, III | 81/177.85 |

*Primary Examiner*—D. S. Meislin
*Attorney, Agent, or Firm*—Calif Tervo

[57] ABSTRACT

A short shaft has: a rear socket for coupling with a drive; a front drive for receiving a socket; and locking components for locking the rear socket to the drive and the front drive to the received socket. A central bore enters the shaft from the rear. A locking bolt and biasing spring go in the central bore and are retrained by a set screw. The locking bolt front end engages a detent ball disposed in a radial cavity in the drive. A thumb lever, disposed in a bore, has an inner end including a bore for engaging the locking bolt rear section for moving the locking bolt and an outer end accessible to a user's thumb for axial movement for moving the bolt from a locking position wherein the detent ball protrudes out of the drive so as to engage a drive socket and prevent its removal to a releasing position wherein the detent ball resides substantially within the front drive so as not to engage a drive socket. In an alternate embodiment, a universal joint is interposed between the rear socket and the locking/front drive apparatus.

12 Claims, 1 Drawing Sheet

LOCKING ADAPTER FOR SOCKET WRENCH

This is a continuation of application Ser. No. 08/008,421, filed Jan. 25, 1993, now abandoned, which is a continuation of application Ser. No. 07/844,457, filed Mar. 2, 1992, now abandoned.

BACKGROUND OF THE INVENTION

1. Field of the Invention

This invention relates, in general, to socket wrench systems and more particularly involves a locking adapter drive for releasingly locking a drive socket to a drive. An alternate embodiment of the locking adapter incorporates a universal joint.

2. Background of the Invention

The desirability of some type of locking drive for a socket wrench system has long been recognized as a means to prevent the system components from uncoupling. For example, U.S. Pat. No. 4,480,511 of M. F. Nickipuck titled "Locking Socket Wrench Drive Device" describes a socket wrench extension having drive end that locks onto a socket, and U.S. Pat. No. 4,502,365 of K. M. Hacker titled "Socket Wrench Extension" also describes an extension with a releasing locking device on the drive. U.S. Pat. No. 4,781,085 titled "Locking Socket Wrench Extension" of current co-inventor L. Fox III describes another such device.

The desirability of a locking ratchet drive is also seen in the prior art. U.S. Pat. No. 4,399,722 of V. Sardo titled "Socket Wrench Including Quick Release Adaptor" describes a ratchet drive including a mechanism for locking a socket to the drive head.

Due to the added complexity and expense of these devices most ratchet drives sold do not contain a locking feature and the conventional locking devices suffer from one or more shortcomings. They are overly complex, expensive, difficult to assemble, difficult to use, or jam or do not work when subjected to a dirty environment. Importantly, they require a considerable amount of space for their implementation which changes the handling characteristics of the tool.

Therefore, there has been a need for a short adapter for converting a conventional ratchet drive into a locking drive such that its addition to the drive does not noticeably alter the performance and handling of the ratchet driver.

Also, because of the non-axial forces exerted on a universal coupling, a universal coupling has more of a tendency to disengage. Therefore, a locking universal adapter is desirable, particularly if it results in no significant added length.

SUMMARY OF THE INVENTION

This invention is a locking adapter for use with a socket system drive member and it generally comprises a shaft having a rear socket for coupling with a drive and having a front drive for receiving a socket and locking components for locking the rear socket to the drive and the front drive to the received socket.

In an exemplary embodiment, the invention includes a central bore entering the shaft from the rear. A locking bolt and biasing spring go in the central bore and are retrained by a set screw. The locking bolt front end engages a detent ball disposed in a radial cavity in the drive. A thumb lever, disposed in a bore, has an inner end including a bore for engaging the locking bolt rear section for moving the locking bolt and an outer end accessible to a user's thumb for axial movement for moving the bolt from its locking position to its release position.

The bolt is movable to a locking position wherein the detent ball protrudes out of the drive so as to engage a drive socket and prevent its removal and to a releasing position wherein the detent ball resides substantially within the front drive so as not to engage a drive socket.

In an alternate embodiment, a universal joint is interposed between the rear socket and the locking/front drive apparatus.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
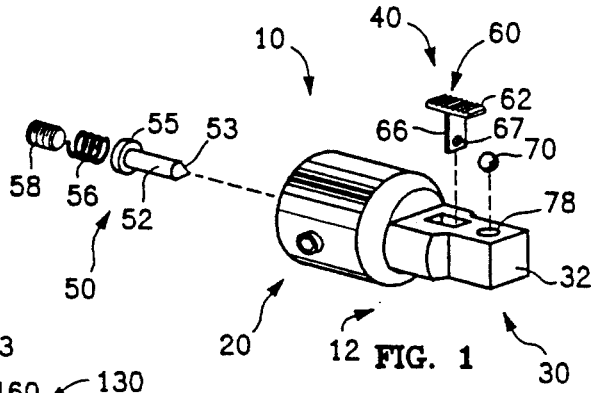
FIG. 1 is an exploded perspective view of a preferred embodiment of the locking adapter for a socket wrench system of the present invention.

With reference now to the drawing, and more particularly to FIG. 1 thereof, there is shown an exploded perspective view of a preferred embodiment of the locking adapter of the present invention, denoted generally as 10, for a socket wrench system.

Locking adapter 10 generally comprises a shaft, denoted generally as 12, having a rear end, denoted generally as 20, a front end, denoted generally as 30, and drive socket locking means, denoted generally as 40.

Front end 30 includes receiving means, such as ⅜" square drive 32, for torque-transferring engagement with the drive socket of a socket wrench system member, such as a socket wrench 90 (FIGS. 2 and 3) or an extension shaft (not shown).

Figure 2:
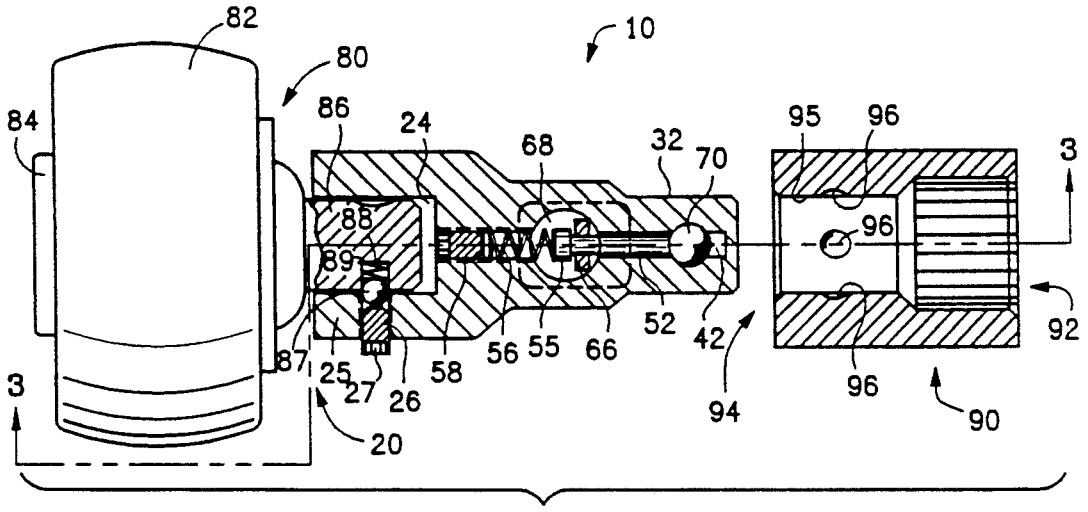
FIG. 2 is an enlarged top elevation view, in partial cross-sectional along line 2—2 of FIG. 3 of the locking adapter 10 of FIG. 1, in use attached to a socket wrench ratchet drive and showing an unattached socket wrench.
Figure 3:
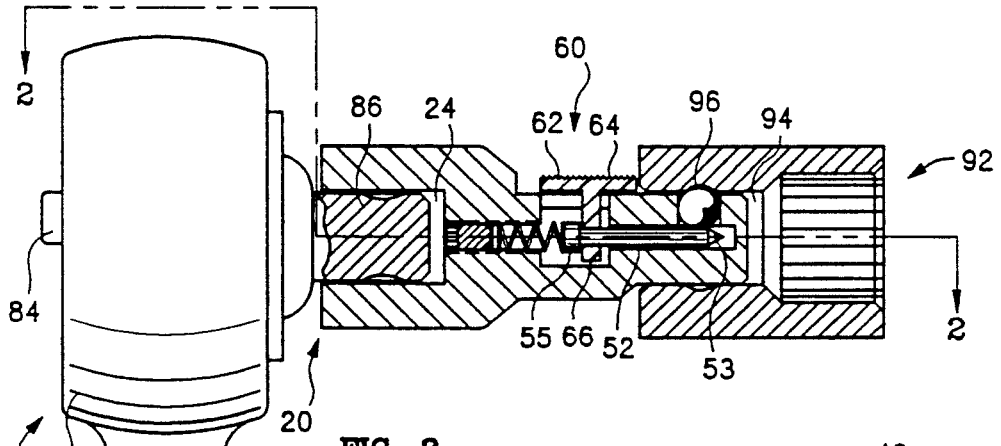
FIG. 3 is a side elevation view, in partial cross-section along line 3—3 of FIG. 2 but showing the socket wrench attached.

Drive socket locking means 40 generally includes: a central bore 42, seen in FIGS. 2 and 3, housing a locking bolt 50, biasing spring 56, and sealing set screw 58; a thumb lever bore 68 housing a thumb lever 60; and a radial cavity 78 housing detent ball 70.

The workings of the invention are best seen in relation to FIGS. 2 and 3. FIG. 2 is a top elevation view, in partial cross-sectional along line 2—2 of FIG. 3, of the locking adapter 10 of FIG. 1 in use as attached to a socket wrench ratchet drive, denoted generally as 80, and showing a socket wrench 90 unattached. FIG. 3 is a side elevation view, in partial cross-section along line 3—3 of FIG. 2, with the exception that socket wrench 90 is attached.

Socket wrench 90 is representative of the common type having a fastener engaging socket 92 for engaging a bolt head or a nut and having a drive socket, denoted generally as 94, for attachment of a torque-transferring device for turning socket wrench 90. Typically, drive socket 94 includes a small depression 96 on each inside wall 95.

Ratchet drive 80 is representative of the typical type having handle 81 (shown partially cut away), ratchet head 82, direction selector switch 84, and drive 86. Drive 86 common includes means, such as detent ball 87 and biasing spring 88 in cavity 89, for more positively retaining a attached socket.

Rear end 20 of locking adapter 10 includes coupling means, such as socket 24, for coupling to socket system drive 86. Means is provided for locking socket 24 to drive 86 including threaded bore 26 through the socket wall 25 containing locking set screw 27. Locking set screw 27 is screwed in to positively attach locking adapter 10 to drive 86. Preferably, locking set screw 27 is located so as to be directly over detent ball 87 such that it can be screwed partially into detent cavity 89 or other depression and thereby positively attach adapter 10 to drive 86.

As best seen in FIG. 3, central bore 42 is formed, typically by drilling, into shaft 12 from the inner end of socket 24. Thumb lever bore 68 and radial bore 78 are formed, typically by drilling, to unite with central bore 42.

Thumb lever 60 basically includes an outer end 62, preferably having a rough or textured surface 64, and an inner end 66. Thumb lever outer end 62 is accessible to a user's thumb for axial movement of thumb lever 60. Thumb lever inner end 66 is disposed in bore 68 and includes engaging means, such as inner end bore 67, for engaging locking bolt 50 for retaining thumb lever 50 and for moving bolt rearward, as will be seen.

A detent, such as ball 70, is disposed in radial cavity 78. The outer entrance of radial cavity 78 is crimped such that detent ball 70 protrude therefrom but cannot exit therethrough.

Locking bolt 60 is inserted into central bore 42. Locking bolt 50 includes a front section 52 and a rear section 55. In the embodiment shown, bolt front section 52 includes a tapered section; in this embodiment, conical tip 53.

Biasing means, such as spring 56, bears against locking bolt rear section 55. Sealing set screw 58 retains spring 56 and bolt 50 in central bore 42 such that spring 56 biases bolt 50 in the forward or locking position as seen in FIGS. 2 and 3.

The drive socket locking means 40 has a locking position, as shown, wherein the forward biased bolt tapered front section 52 raises detent ball 70 in radial cavity 78 until ball 70 protrudes sufficiently from drive 32 so as to engage depression 96 in socket 94 and prevent removal of socket 94 from drive 32. As seen in FIG. 2, In the fully locked position, detent ball 70 is supported by bolt 50 such that force on detent ball 70 cannot force its retraction and such that detent ball 70 can only be retracted from the locking position by moving bolt 50 rearward.

Bolt rear section 55 is of larger diameter than front section 52 such that bolt front section 52 passes through thumb lever inner end bore 67 but rear section 55 cannot. Thumb lever inner end 66 engages locking bolt rear section 55. A user can overcome the spring biasing force and move thumb lever 60 axially rearward whereby bolt 50 moves rearward from its biased forward locking position to a releasing position wherein detent ball 70 can retract sufficiently into radial cavity 78 such that it will not engage socket 94. In the embodiment shown, in releasing position, detent ball 70 resides partially in central bore 42.

To attach a socket, thumb lever 60 is moved rearward and socket 94 is placed on drive 32. Upon release of thumb lever 60, bias spring 56 moves bolt 50 forward to the locking position.

In the above-described manner, any drive member of a socket wrench system can be converted to a locking drive member such that an attached socket cannot come off the drive except by intent of the user. Locking adapter is extremely compact and is typically only about ⅜" longer than a standard ⅜" non-locking adapter. Because of this compactness, it is unobtrusive and desirable to use in converting a non-locking drive to a locking drive.

Figure 4:
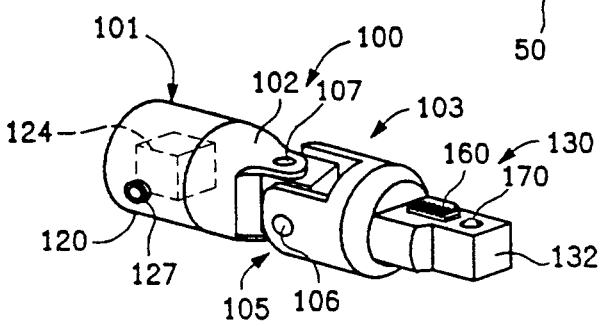
FIG. 4 is a perspective view of an alternate embodiment of the adapter of FIG. 1 as modified for use on a universal adapter.

FIG. 4 is a perspective view of an alternate embodiment of the adapter of FIG. 1 as modified for use on a universal joint, denoted generally as 110. Locking universal joint 110 generally comprises a rear member 101 and a front member 103 joined together by a universal joint or gimbal, denoted generally as 105.

Universal joint 105 includes a first axis 106 about which front member 103 can rotate and second axis 107, at a right angle to first axis 106, about which rear member 101 can rotate.

Rear member 101 has a rear end 120 including coupling means, such as socket 124, shown in phantom, for coupling to a drive and a front end 102. Locking set screw 127 is similar to set screw 27 and it can be screwed in to positively lock a drive in socket 124.

Front member 103 includes a front end 130 including a drive 132 and means for locking a socket on the drive including thumb lever 160 and detent 170. Thus, front member 103 is basically the same as locking adapter 10 without rear end socket 24 and locking set screw 27.

In this manner a very compact locking universal joint is created which is only slightly longer than a conventional universal joint.

Having described the invention, it can be seen that it provides a very convenient and unobtrusive device for releasingly locking a drive member to a socket.

Although particular embodiments of the invention have been illustrated and described, various changes may be made in the form, composition, construction, and arrangement of the parts without sacrificing any of its advantages. For example, although the adapter has been illustrated and described as attached to the socket of a socket wrench; the invention is not so limited and can be attached to the socket of an extension drive to any like member. Therefore, it is to be understood that all matter herein is to be interpreted and illustrative and not in any limiting sense and it is intended to cover in the appended claims such modifications as come within the true spirit and scope of the invention.

We claim:

1. A locking adapter for use with a drive member of a socket wrench system; said locking adapter comprising:

a shaft having:

a rear end including:

a rear free end surface;

coupling means for coupling said rear end to a socket system drive; and a front end including: receiving means for torque-transferring engagement with a socket wrench system drive socket; and drive socket locking means for locking a drive socket onto said receiving means; said drive socket locking means being operable between a first position for positively locking a drive socket to said receiving means and a second position for releasing a drive socket; said drive socket locking means comprising:

a central bore within said shaft extending from said shaft rear free end surface;

a thumb lever bore extending radially from said central bore and exiting said shaft;

a radial cavity from said central bore through said receiving means;

a detent disposed in said radial cavity in said receiving means; when said locking means is in its locking position, said detent having a locking position wherein it protrudes out of said receiving means so as to engage a drive socket and prevent its removal from said receiving means; when said locking means is in its releasing position, said detent having a releasing position wherein it resides substantially within said receiving means so as not to engage a drive socket;

a locking bolt within said central bore including:

a front section; and a rear section;

said bolt being axially moveable such that as said bolt is moved from a release position to a locking position, its said front section contacts and moves said detent from its release position to its locking position;

retaining means releasably attached to said shaft for retaining a spring biasing means in said central bore;

spring biasing means in said central bore for biasing said bolt in its locking position; said spring biasing means having:

a fore end bearing against said locking bolt rear section; and an aft end bearing against said retaining means; and a thumb lever disposed in said thumb lever bore; said thumb lever having;

an inner end including:

engaging means for engaging said locking bolt rear section for moving said locking bolt to the releasing position; and an outer end accessible to a user's thumb for axial movement for moving said bolt from its locking position to its release position.

2. The locking adapter of claim 1 wherein:

said rear end includes:

means for locking said coupling means to a socket system drive.

3. The locking adapter of claim 1 wherein:

said thumb lever inner end engaging means includes:

a bore through said thumb lever inner end; and wherein said locking bolt rear section is of larger dimension than said thumb lever bore such that it will not pass through said thumb lever bore and said locking bolt front section is of a smaller dimension than said thumb lever bore such that it will pass through said thumb lever bore and extend through said thumb lever bore.

4. The locking adapter of claim 2 wherein:

said coupling means includes:

a socket including a surrounding wall; and said means for locking said coupling means to a socket system drive includes:

a threaded bore through said socket wall of said coupling means; and an adjustable set screw in said threaded bore.

5. The locking adapter of claim 1 wherein:

said central bore is blind.

6. The locking adapter of claim 1 wherein:

said central bore is stepped-down.

7. The locking adapter of claim 1 wherein:

said retaining means is selectively positionable such that the biasing of said spring biasing means is adjustable.

8. In combination:

a drive ratchet of a socket wrench system including:

a handle; and a drive member; and a locking adapter for use with said drive member comprising:

a shaft having:

a rear end including:

a rear free end surface;

coupling means for coupling said rear end to said ratchet drive member; and a front end including:

receiving means for torque-transferring engagement with a socket wrench system drive socket; and drive socket locking means for locking a drive socket onto said receiving means; said drive socket locking means being operable between a first position for positively locking a drive socket to said receiving means and a second position for releasing a drive socket; said drive socket locking means comprising:

a central bore within said shaft extending from said shaft rear free end surface;

a thumb lever bore extending radially from said central bore and exiting said shaft;

a radial cavity from said central bore through said receiving means;

a detent disposed in said radial cavity in said receiving means; when said locking means is in its locking position, said detent having a locking position wherein it protrudes out of said receiving means so as to engage a drive socket and prevent its removal from said receiving means; when said locking means is in its releasing position, said detent having a releasing position wherein it resides substantially within said receiving means so as not to engage a drive socket;

a locking bolt within said central bore including:

a front section; and a rear section;

said bolt being axially moveable such that as said bolt is moved from a release position to a locking position, its said front section contacts and moves said detent from its release position to its locking position;

retaining means releasably attached to said shaft for retaining a spring biasing means in said central bore;

spring biasing means in said central bore for biasing said bolt in its locking position; said spring biasing means having:

a fore end bearing against said locking bolt rear section; and an aft end bearing against said retaining means; and a thumb lever disposed in said thumb lever bore; said thumb lever having;
an inner end including:
engaging means for engaging said locking bolt rear section for moving said locking bolt to the releasing position; and
an outer end accessible to a user's thumb for axial movement for moving said bolt from its locking position to its release position.

9. The locking adapter of claim 8 wherein:
said rear end includes:
means for locking said coupling means to said ratchet drive member.

10. The locking adapter of claim 8 wherein:
said thumb lever inner end engaging means includes:
a bore through said thumb lever inner end; and wherein said locking bolt rear section is of larger dimension than said thumb lever bore such that it will not pass through said thumb lever bore and said locking bolt front section is of a smaller dimension than said thumb lever bore such that it will pass through said thumb lever bore and extend through said thumb lever bore.

11. A locking adapter for use with a drive member of a socket wrench system; said locking adapter comprising:
a shaft having:
a rear end including:
a rear free end surface;
coupling means for coupling said rear end to a socket system drive; and
a front end including:
receiving means for torque-transferring engagement with a socket wrench system drive socket; and
drive socket locking means for locking a drive socket onto said receiving means; said drive socket locking means being operable between a first position for positively locking a drive socket to said receiving means and a second position for releasing a drive socket; said drive socket locking means comprising:
a blind, stepped-down central bore within said shaft extending from said shaft rear free end surface;
a thumb lever bore extending radially from said central bore and exiting said shaft;
a radial cavity from said central bore through said receiving means;
a detent disposed in said radial cavity in said receiving means; when said locking means is in its locking position, said detent having a locking position wherein it protrudes out of said receiving means so as to engage a drive socket and prevent its removal from said receiving means; when said locking means is in its releasing position, said detent having a releasing position wherein it resides substantially within said receiving means so as not to engage a drive socket;
a locking bolt within said central bore including:
a front section; and
a rear section;
said bolt being axially moveable such that as said bolt is moved from a release position to a locking position, its said front section contacts and moves said detent from its release position to its locking position;
retaining means releasably attached to said shaft for retaining a spring biasing means in said central bore;
spring biasing means in said central bore for biasing said bolt in its locking position; said spring biasing means having:
a fore end bearing against said locking bolt rear section; and
an aft end bearing against said retaining means; and
a thumb lever disposed in said thumb lever bore; said thumb lever having;
an inner end including:
engaging means for engaging said locking bolt rear section for moving said locking bolt to the releasing position; and
an outer end accessible to a user's thumb for axial movement for moving said bolt from its locking position to its release position.

12. The locking adapter of claim 11 wherein:
said retaining means is selectively positionable such that the biasing of said spring biasing means is adjustable.

* * * * *